US007281508B2

(12) United States Patent
Bauer et al.

(10) Patent No.: US 7,281,508 B2
(45) Date of Patent: Oct. 16, 2007

(54) CYLINDER HEAD COVER ASSEMBLY FOR THE CYLINDER HEAD OF AN INTERNAL COMBUSTION ENGINE AND PROCESS FOR PRODUCING A CYLINDER HEAD COVER ASSEMBLY

(75) Inventors: Sascha Bauer, Auenwald (DE); Jochen Linhart, Waiblingen (DE); Michael Fasold, Auenwald (DE); Peter Mueller, Saarbruecken (DE); Ralf Salameh, Gondelsheim (DE)

(73) Assignees: Mann & Hummel GmbH, Ludwigsburg (DE); Federal-Mogul Sealing Systems Bretten GmbH, Bretten (DE)

( * ) Notice: Subject to any disclaimer, the term of this patent is extended or adjusted under 35 U.S.C. 154(b) by 87 days.

(21) Appl. No.: 11/293,152

(22) Filed: Dec. 5, 2005

(65) Prior Publication Data

US 2006/0118073 A1 Jun. 8, 2006

(30) Foreign Application Priority Data

Dec. 4, 2004 (DE) ..... 10 2004 058 481

(51) Int. Cl.
*F01M 9/10* (2006.01)

(52) U.S. Cl. ..... 123/90.38; 123/90.37; 123/195 C; 123/198 E; 413/9; 413/58; 413/63; 413/64; 277/592; 277/596; 277/597; 277/916

(58) Field of Classification Search ..... 123/90.38
See application file for complete search history.

(56) References Cited

U.S. PATENT DOCUMENTS

| | | | | |
|---|---|---|---|---|
| 5,511,518 | A * | 4/1996 | Jain et al. | 123/90.37 |
| 5,513,603 | A * | 5/1996 | Ang et al. | 123/90.37 |
| 5,957,100 | A * | 9/1999 | Frohwerk et al. | 123/90.38 |
| 6,520,134 | B1 * | 2/2003 | Plunkett et al. | 123/90.38 |
| 6,896,098 | B2 * | 5/2005 | Vom Stein et al. | 181/204 |

FOREIGN PATENT DOCUMENTS

DE 197 38 275 A1 3/1999

* cited by examiner

*Primary Examiner*—Thomas Denion
*Assistant Examiner*—Kyle M. Riddle
(74) *Attorney, Agent, or Firm*—Crowell & Moring LLP

(57) ABSTRACT

A rocker cover assembly for a cylinder head of an internal combustion engine includes a rock cover, a gasket element and a stabilizing core. The gasket element is disposed between the rocker cover and the cylinder head, and includes a sealing material. The stabilizing core is inserted in the gasket element and surrounded at least essentially completely by the sealing material of the gasket element. The stabilizing core is isolated from the rocker cover such that the sealing material of the gasket element is arranged between the stabilizing core and the rocker cover.

2 Claims, 3 Drawing Sheets

CYLINDER HEAD COVER ASSEMBLY FOR THE CYLINDER HEAD OF AN INTERNAL COMBUSTION ENGINE AND PROCESS FOR PRODUCING A CYLINDER HEAD COVER ASSEMBLY

This application claims the priority of German Patent Application No. 10 2004 058 481.8, filed Dec. 4, 2004, the entire disclosure of which is incorporated herein by reference.

FIELD OF THE INVENTION

The present invention relates to a rocker cover assembly for a cylinder head of an internal combustion engine and a method for manufacturing a rocker cover assembly.

SUMMARY OF THE INVENTION

German Patent DE 197 38 275 A1 describes a rocker cover for the cylinder head of an internal combustion engine, which is mounted on the cylinder head by screws. A peripheral gasket is provided for creating a seal between the cover and the cylinder head. The gasket is extruded or buttoned onto a protruding flange on the rocker cover. A sealing lip of the gasket protrudes beyond the lower end face of the rocker cover so that this sealing lip rests on the neighboring top side of the cylinder head when the rocker cover is installed in the proper position, thereby providing a flow-tight closure between the cylinder head and the rocker cover.

However, satisfactory sound insulation between the cylinder head and the rocker cover is not achieved with this device. In the installed state, the fastening force created by the screw connection causes end face sections of the rocker cover to rest on the top side of the cylinder head, so that engine vibrations are transmitted directly to the rocker cover, where unwanted vibration noise occurs. This vibration transmission cannot be avoided even with the sealing lip of the peripheral gasket protruding above the end face because there is always the risk that a section of the rocker cover may come in direct contact with the cylinder head due to the high fastening force.

The present invention is based on a problem of creating a rocker cover that has a simple design and is effectively shielded from engine vibrations despite a flow-tight seal. Expediently, the rocker cover including the gasket should be easy to manufacture.

This problem is solved according to this invention with a rocker cover assembly and a method for manufacturing a rocker cover assembly.

The inventive rocker cover assembly is equipped with a gasket element designed expediently as a part running along the outside edge of the rocker cover. A stabilizing core is inserted into the gasket element and surrounded completely or at least almost completely by the sealing material of the gasket element. Between the stabilizing core and the rocker cover there is a sealing material of the gasket element. This ensures that the stabilizing core does not come in direct contact with the rocker cover or the cylinder head. Instead, the sealing material of the gasket element, which ensures effective vibration isolation, is provided between the stabilizing core and the rocker cover as well as between the stabilizing core and the cylinder head.

At the same time, much higher sealing forces are achieved when using a stabilizing element (e.g., a stabilizing core). This also leads to an improved, more stable connection of the rocker cover to the cylinder head without the risk of unwanted lateral yielding of the sealing material. Despite the higher sealing forces, it is possible to connect the rocker cover to the cylinder head in such a manner that no section of the rocker cover comes in direct contact with the cylinder head but instead there is only sealing material between the cylinder head and the rocker cover.

In a preferred embodiment, the gasket element runs along the outside edge of the rocker cover and is thus designed as a closed ring. In this case, the stabilizing core also forms a supporting ring, running peripherally accordingly. This supporting ring expediently has at least one passage which is bridged by the sealing material of the gasket element, thus forming a cohesive ring-shaped gasket element despite the passage. Because of the passage, the supporting ring is able to compensate for thermal expansion in length. In principle, it is sufficient to provide only small passages in the supporting ring in the longitudinal and transverse directions of the gasket element to avoid having a negative effect on stability. If necessary, a plurality of passages may also be provided over the length of the gasket element.

In an advantageous embodiment, the stabilizing core and/or the supporting ring have/has a U-shaped cross section; a protrusion on the cylinder head having a complementary shape can be inserted into the open end of the U. Stabilization and a sealing effect are thus achieved in the vertical fastening direction and also the horizontal direction.

In a first operation in the inventive method for manufacturing the rocker cover including the gasket element, the rocker cover is manufactured as a plastic molding in a plastic injection molding process, while at the same time the stabilizing core and/or the supporting ring is/are molded in one piece with the rocker cover as a whole or in multiple parts. The stabilizing core or supporting ring is connected to the rocker cover by a narrow connecting web. The function of this connecting web is that of a predetermined breaking point by which the stabilizing core is separated from the rocker cover in the second step. In the third manufacturing step, the stabilizing core is first attached by auxiliary means in relation to the rocker cover and then sheathed with an elastomer, thereby creating the gasket element. The auxiliary means for attaching the stabilizing core with respect to the rocker cover may then be removed. In this way, the rocker cover including the gasket element is manufactured in a single manufacturing operation. Because of the integrated stabilizing core, the gasket element here has a much greater stability than a gasket element without an integrated stabilizing core.

If it is impossible to manufacture the injection molded part in one piece (rocker cover and supporting ring), they may also be manufactured separately, in which case the rocker cover and the supporting ring are inserted jointly into the elastomer mold and sheathed by extrusion.

It may be expedient to create a direct connection between the gasket element and the rocker cover in the sense of a hook design by extrusion of elastomer, e.g., onto a protrusion or an undercut on the rocker cover, thereby eliminating the need for additional fastening measures.

According to another method, the supporting ring is manufactured as an independent component and is sheathed with extruded elastomer material to form a gasket element. The gasket element is then inserted into an injection mold for the rocker cover and the rocker cover is extruded onto the gasket element.

This manufacturing method offers the advantage that it requires little effort for manufacturing the elastomer. Furthermore, the elastomer molds may have a simple design. Since the heating operation takes place before the manufacture of the rocker cover, the problem of deformation is reduced. The mechanical anchoring of the gasket on the rocker cover can be achieved easily. Furthermore, there is greater design freedom in the geometry of the gasket.

BRIEF DESCRIPTION OF THE DRAWINGS

The same components in the figures are labeled with the same reference numerals.

DETAILED DESCRIPTION OF PREFERRED EMBODIMENTS

Figure 1:
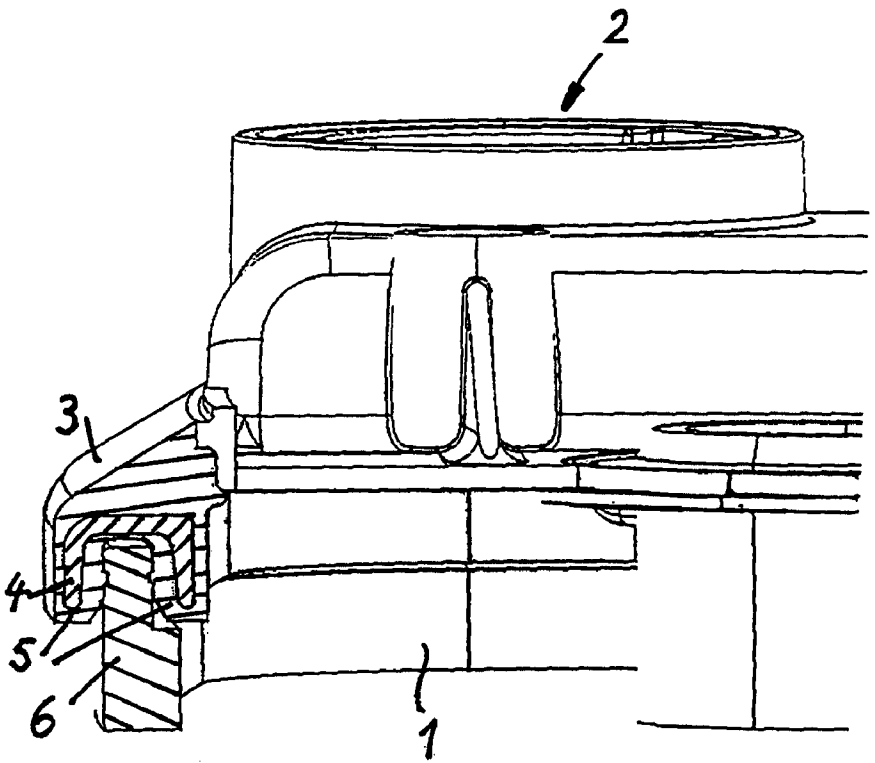
FIG. 1 shows a view of a rocker cover, which is placed on a cylinder head, having a partial section in the area of a gasket element between the bottom side of the rocker cover and the top side of the cylinder head.

FIG. 1 shows the upper section of a cylinder head 1 of an internal combustion engine with the rocker cover 2 attached. A peripheral ring-shaped gasket element 3, which is expediently extruded onto the rocker cover 2, is provided in the area of the outside edge of the rocker cover 2 for a flow-tight seal between the cylinder head 1 and the rocker cover 2, which is manufactured as a plastic molding. A supporting ring 4, also peripheral, is introduced into the gasket body of the gasket element 3; the supporting ring is made of the same plastic material as the rocker cover 2. The supporting ring 4 is designed to be U-shaped, with the opening in the supporting ring pointing downward in the embodiment shown. The supporting ring 4 is completely surrounded by the material of the gasket element 3, which is accomplished as part of an extrusion process in which gasket elastomer is extruded onto the supporting ring 4. Because the supporting ring 4 is U-shaped, the legs of the supporting ring are also surrounded by sealing material, thus forming two sealing legs 5. The gasket element 3 also has a receptacle corresponding to the shape of the supporting ring 4 and two lateral sealing legs 5. With the rocker cover 2 installed, a protrusion 6, which is designed in one piece with the cylinder head and is raised above the top side of the cylinder head, protrudes into this receptacle in the gasket element. The protrusion 6 protruding into the U-shaped receptacle is accommodated in both vertical and lateral directions, so that the rocker cover 2 is held on the cylinder head 1 in a very stable position without any direct contact between the cylinder head 1 and the material of the rocker cover 2. Sealing material of the gasket element 3 is always arranged between the cylinder head 1 and the rocker cover 2.

Figure 2:
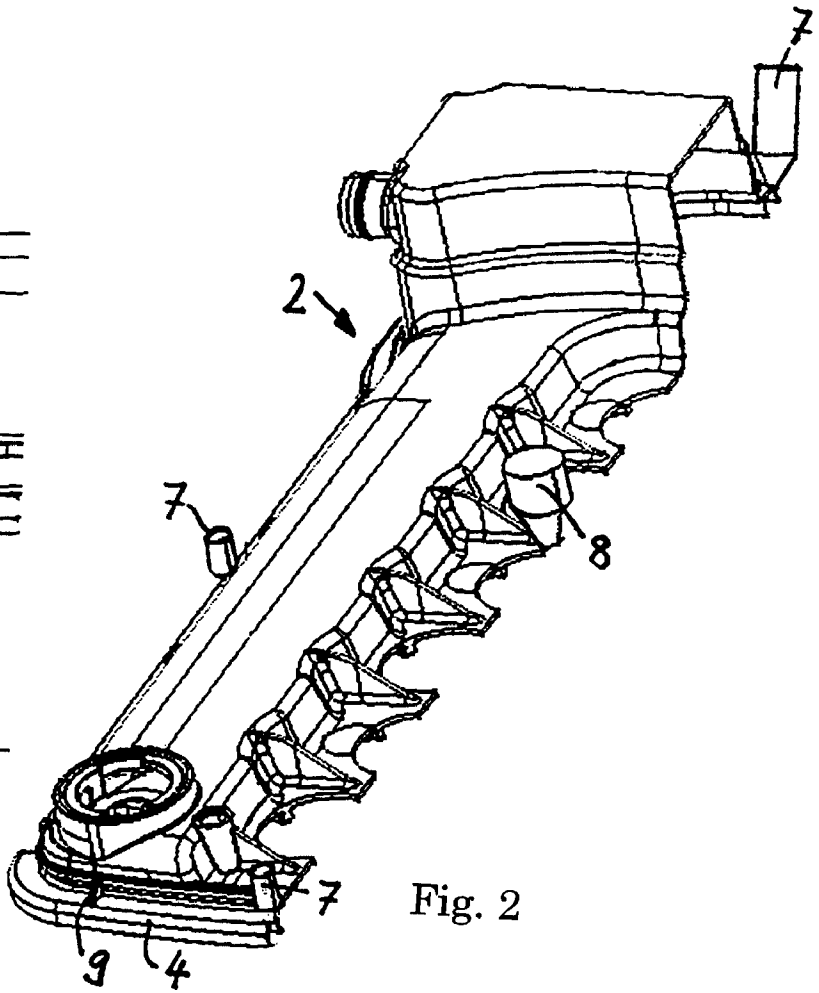
FIG. 2 shows a perspective view of the rocker cover having an extruded supporting ring made of the same material as the rocker cover and sheathed by an elastomer to produce a peripheral gasket element in a subsequent manufacturing step.

FIG. 2 shows the rocker cover 2 in an intermediate stage in the manufacturing process. The supporting ring 4 is manufactured in the same operation as the rocker cover 2; sprue domes 7 are distributed around the circumference for the introduction of the injection molding material for the supporting ring 4. A corresponding sprue dome 8 is also provided for the manufacture of the rocker cover molding. The supporting ring 4 is connected to the rocker cover by narrow connecting webs 9, which are distributed over the circumference of the rocker cover 2. These supporting webs 9 serve as a predetermined breaking point which can be broken to release the supporting ring 4 from the rocker cover 2.

Figure 3:
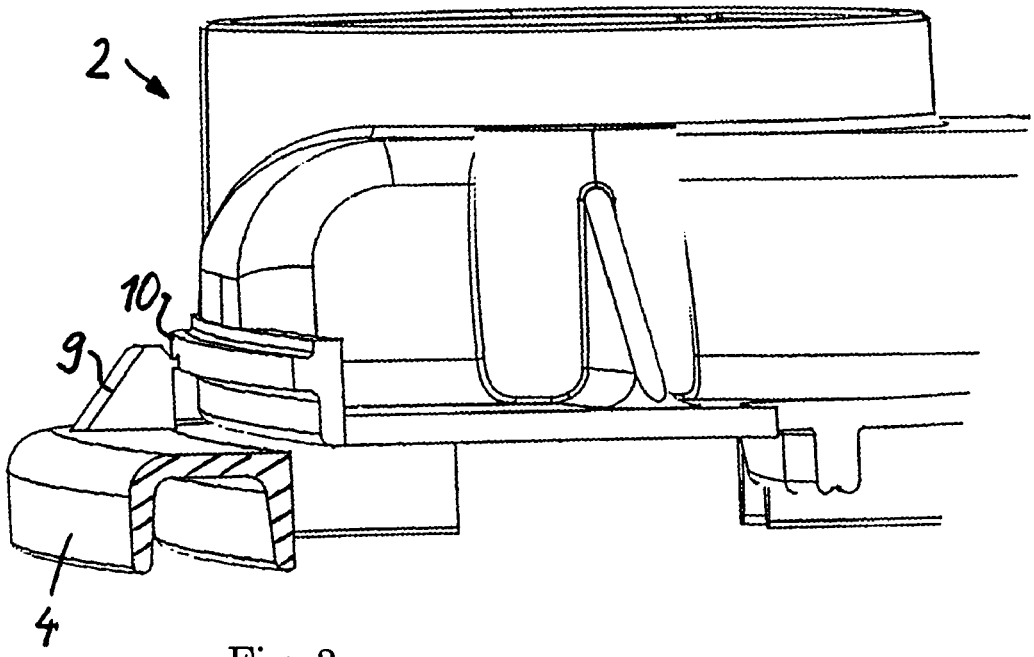
FIG. 3 shows another view of the rocker cover with the peripheral supporting ring, where the supporting ring, shown here in a sectional view, is connected to the rocker cover by a connecting web.
Figure 4:
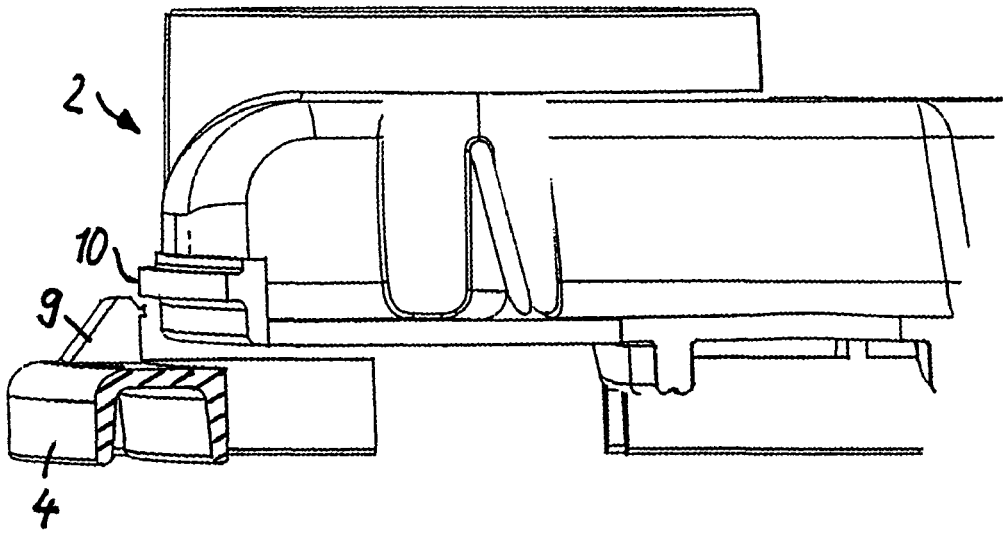
FIG. 4 shows a view corresponding to that in FIG. 3 but with the connecting web detached, so that the supporting ring is independent of the rocker cover.

FIG. 3 shows the rocker cover 2 at the same stage of the process as in FIG. 2. This shows clearly the connecting web 9 which is connected to the outside of a peripheral flange 10 on the rocker cover 2 only by a small connection. This weak connection is sufficient to hold the supporting ring 4 on the rocker cover 2 initially during the first manufacturing step. However, the connection can be broken by applying only a slight force, so the supporting ring 4 has no connection to the rocker cover 2 illustrated in FIG. 4.

Figure 5:
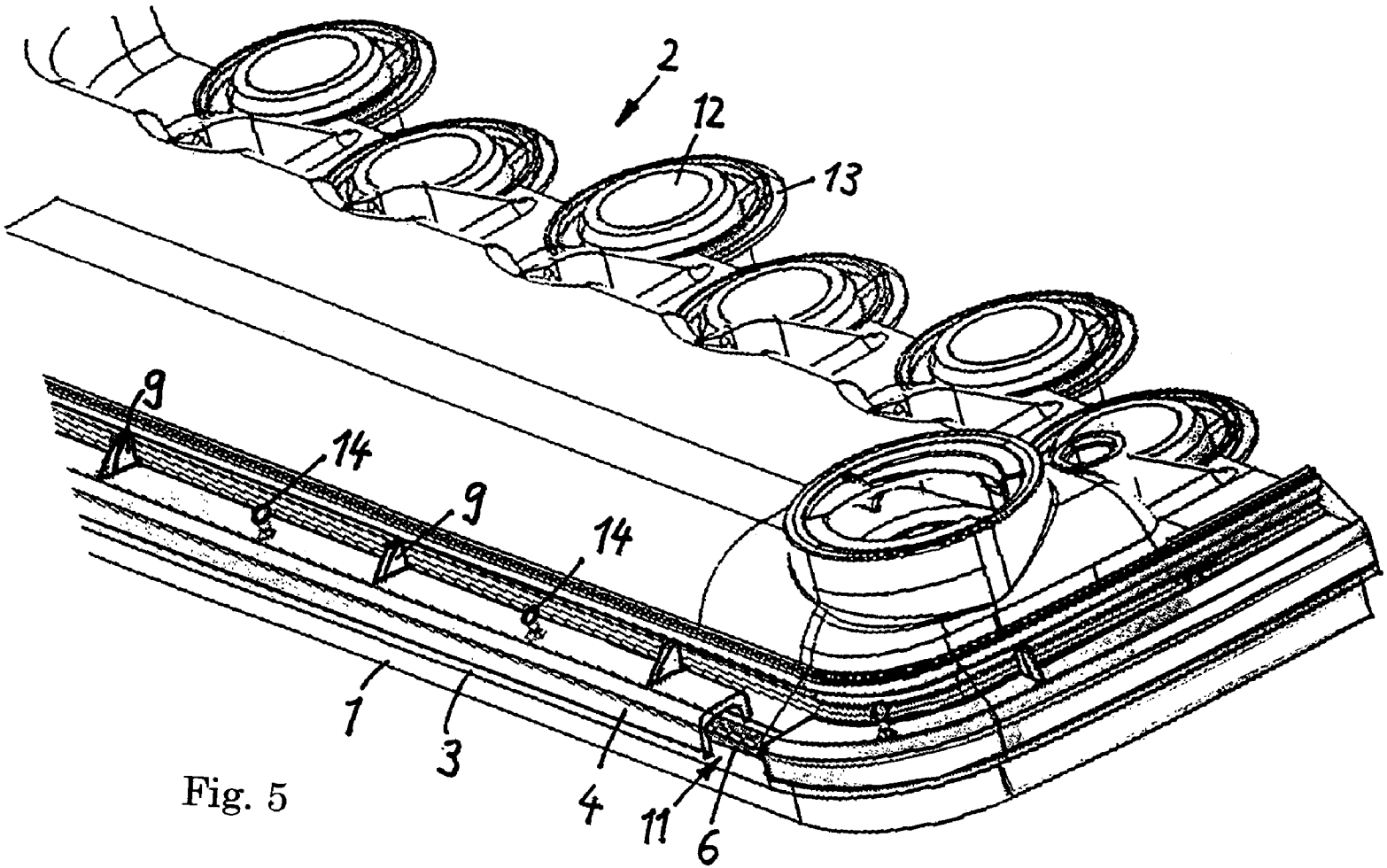
FIG. 5 shows a perspective view of the rocker cover with the peripheral gasket element, which is extruded on the outside edge of the rocker cover and is integrated into the supporting core.

FIG. 5 shows the rocker cover 2 in the installed position on the cylinder head 1. The gasket element 3 runs around the outside edge of the rocker cover 2 with the supporting ring 4 inserted into the gasket element 3. The connecting webs 9 which are connected to the rocker cover 2 during the manufacturing process can be seen here but now they are released from the rocker cover. The supporting ring 4 including the connecting webs 9, which now have only the function of stabilizing the gasket element 3, are completely sheathed by the gasket material of the gasket element. An elastomer is used as gasket material.

The supporting ring 4 has at least one passage 11, so that the supporting ring does not run completely around the periphery and therefore is capable of compensating for thermally induced changes in length. This passage 11 is bridged by the sealing material of the gasket element. Additional stabilization in the area of the passage 11 is provided by the protrusion 6, which is part of the cylinder head 1 and protrudes from the bottom into the U-shaped receptacle of the supporting ring 4.

This also shows domes 12, which are part of the rocker cover 2 and serve to accommodate the spark plugs for the internal combustion engine. The domes 12 are surrounded by radial gaskets 13, which do not usually have a stabilizing supporting ring but may be designed with such a supporting ring if necessary. The radial gaskets 13 are expediently manufactured in the same operation as the peripheral gasket element 3.

In addition, FIG. 5 also shows recesses 14 in the gasket element 3 which are formed due to the fact that the supporting core 4 must be held by auxiliary elements after being released from the rocker cover 2 during the manufacturing process, whereupon the supporting ring is sheathed by the elastomer to produce the gasket element, whereby the recesses 14 are filled by the auxiliary elements for holding the supporting ring during the injection operation. After the end of the injection process, the gasket element is permanently attached to the rocker cover and the auxiliary elements for holding the supporting ring may be removed, thus forming the recesses 14.

Oil pans made of plastic can essentially also be manufactured by the inventive production process. In this case, the oil pan is manufactured by the plastic injection molding process with a stabilizing core arranged on the outside of the oil pan, whereby the stabilizing core is connected to the oil pan by a connecting web that functions as a predetermined breaking point. Then the stabilizing core is released from the oil pan at the predetermined breaking point and the stabilizing core is sheathed by an elastomer while at the same time the stabilizing core is secured with respect to the oil pan. The stabilizing core is expediently designed as a supporting ring running along the outside edge of the oil pan.

According to another manufacturing process, the supporting ring is manufactured as an independent part which is sheathed with elastomer material to form a gasket element. The gasket element is then inserted into an injection mold for the oil pan and the oil pan is extruded onto the gasket element.

The invention claimed is:

1. A method for manufacturing a rocker cover assembly, the method comprising:

manufacturing a rocker cover and a stabilizing core of the rocker cover assembly by a plastic injection molding process, with the stabilizing core being situated on an outside edge of the rocker cover and being connected to the rocker cover by a guide web as a predetermined breaking point;

detaching the stabilizing core at the predetermined breaking point from the rocker cover; and sheathing the stabilizing core with an elastomer while simultaneously securing the stabilizing core to the rocker cover.

2. The method as claimed in claim 1, further comprising extruding the stabilizing core as a supporting ring running along the outside edge of the rocker cover.

* * * * *